US009096054B2

(12) United States Patent
Moncavage

(10) Patent No.: US 9,096,054 B2
(45) Date of Patent: Aug. 4, 2015

(54) WIPER BLADE HOLDER FOR USE IN A SCREEN PRINTING MACHINE AND WIPER BLADE THEREFOR

(75) Inventor: Charles Moncavage, Nazareth, PA (US)

(73) Assignee: ASM Assembly Systems Switzerland GmbH, Zurich (CH)

( * ) Notice: Subject to any disclaimer, the term of this patent is extended or adjusted under 35 U.S.C. 154(b) by 459 days.

(21) Appl. No.: 12/523,217

(22) PCT Filed: Jan. 14, 2008

(86) PCT No.: PCT/EP2008/000229

§ 371 (c)(1),
(2), (4) Date: Aug. 25, 2010

(87) PCT Pub. No.: WO2008/086995

PCT Pub. Date: Jul. 24, 2008

(65) Prior Publication Data

US 2011/0041278 A1 Feb. 24, 2011

(30) Foreign Application Priority Data

Jan. 15, 2007 (GB) ..... 0700726.3

(51) Int. Cl.
*B41F 15/44* (2006.01)

(52) U.S. Cl.
CPC ..... *B41F 15/44* (2013.01)

(58) Field of Classification Search
CPC ..... B41F 15/44
USPC ..... 15/236.01, 245, 245.1, 250.361, 256.5, 15/256.51; 101/120, 123, 157, 169, 423, 101/425
See application file for complete search history.

(56) References Cited

U.S. PATENT DOCUMENTS

| | | | | |
|---|---|---|---|---|
| 3,089,175 | A * | 5/1963 | Hinder | 15/250.43 |
| 3,097,390 | A * | 7/1963 | Thaler | 15/256.51 |
| 3,521,561 | A * | 7/1970 | Bryer et al. | 101/169 |
| 3,566,784 | A * | 3/1971 | Mitter | 101/120 |

(Continued)

FOREIGN PATENT DOCUMENTS

| | | |
|---|---|---|
| EP | 0504501 | 9/1992 |
| EP | 0732199 | 9/1996 |

(Continued)

OTHER PUBLICATIONS

International Search Report for corresponding application No. PCT/EP2008/000229 completed Apr. 14, 2008.

*Primary Examiner* — Monica Carter
*Assistant Examiner* — Michael Jennings
(74) *Attorney, Agent, or Firm* — Renner, Otto, Boisselle & Sklar, LLP

(57) ABSTRACT

A wiper blade holder for holding a wiper blade (103) for use in a screen printing machine and a wiper blade therefor, the wiper blade holder comprising: a body unit (101) comprising a body member (107) which includes a mounting surface (123) to which a wiper blade is mounted; and at least one mounting fixture (105) which is attached to the body unit for mounting the wiper blade holder to a screen printing machine. In one embodiment the wiper blade holder further comprises: at least one magnet (109) which acts to hold the wiper blade to the body unit. In one embodiment the at least one mounting fixture is separable from the body member, such as to allow for use of different mounting fixtures which provide for adjustment of the inclination of the mounting surface of the body member relative to the at least one mounting fixture.

44 Claims, 3 Drawing Sheets

(56) References Cited

U.S. PATENT DOCUMENTS

| | | | | |
|---|---|---|---|---|
| 4,557,194 | A * | 12/1985 | Zimmer | 101/120 |
| 4,736,485 | A * | 4/1988 | Egner-Walter et al. | 15/250.202 |
| 5,515,570 | A * | 5/1996 | Muscroft | 15/220.2 |
| 5,878,306 | A * | 3/1999 | Michlin | 399/106 |
| 6,196,126 | B1 * | 3/2001 | Smith et al. | 101/114 |
| 6,206,978 | B1 * | 3/2001 | Tsui | 134/8 |
| 6,267,818 | B1 | 7/2001 | Volpe, Jr. | |
| 6,348,104 | B1 * | 2/2002 | Bakker | 134/6 |
| 6,634,052 | B2 * | 10/2003 | Hanson | 15/220.2 |
| 6,763,546 | B1 * | 7/2004 | Smith | 15/250.04 |
| 7,054,575 | B1 * | 5/2006 | Michlin | 399/106 |
| 7,313,841 | B2 * | 1/2008 | Huang | 15/220.2 |
| 2004/0057747 | A1 * | 3/2004 | Michlin | 399/106 |
| 2008/0083082 | A1 * | 4/2008 | Rovaart et al. | 15/250.32 |

FOREIGN PATENT DOCUMENTS

| | | |
|---|---|---|
| GB | 789175 | 1/1958 |
| GB | 2242647 | 10/1991 |
| WO | 92/16308 | 10/1992 |

* cited by examiner

WIPER BLADE HOLDER FOR USE IN A SCREEN PRINTING MACHINE AND WIPER BLADE THEREFOR

This application is a national phase of International Application No. PCT/EP2008/000229 filed Jan. 14, 2008 and published in the English language.

The present invention relates to a wiper blade holder for use in a screen printing machine and a wiper blade therefor, with such wiper blades often being referred to as squeegee blades.

A conventional wiper blade holder is illustrated in FIG. 1. The wiper blade holder comprises an elongate body member 1, which includes a pair of screw studs 3 for fixing the wiper blade holder to a screen printing machine, and a wiper blade 7, which is clamped to the body member 1 by a clamping bar 9 and a plurality of fixing screws 11 which are screwed to the body member 1 at spaced locations along the length of the clamping bar 9.

Wiper blades are subject to wear and prone to damage during use, and, if not replaced, would result in a degradation in the print quality. Thus, it is necessary regularly to replace wiper blades.

With a conventional wiper blade holder, as illustrated in FIG. 1, replacement of the wiper blade 7 requires the removal of the fixing screws 11 and the clamping bar 9, and in many cases the removal of the body member 1 from the screen printing machine.

These operations are both time consuming and prone to problems as caused by misplacing the fixing screws 11 or improper assembly.

In addition, the printing material, typically solder paste, can accumulate around the clamping bar 9, and in particular the fixing screws 11, which makes it difficult to remove the wiper blade 7.

This accumulation of the printing material is particularly problematic where using both lead-free and lead-based solder pastes with the one wiper blade holder, as cross-contamination can occur.

These problems are compounded by the fact that conventional screen printing machines use two such wiper blade holders, one for printing in each direction, and, for ease of fixing, the screw studs 3 of these wiper blade holders are at different pitches, requiring the two wiper blade holders to be maintained.

It is an aim of the present invention to provide an improved wiper blade holder which facilitates the replacement of the wiper blades, and a wiper blade therefor.

In one aspect the present invention provides a wiper blade holder for holding a wiper blade for use in a screen printing machine, the wiper blade holder comprising: a body unit comprising a body member which includes a mounting surface to which a wiper blade is mounted; at least one mounting fixture which is attached to the body unit for mounting the wiper blade holder to a screen printing machine; and at least one magnet which acts to hold the wiper blade to the mounting surface of the body unit.

In one embodiment the body member includes an attachment slot in an upper edge thereof, in which the at least one mounting fixture is slideably disposed, such as to allow for positional adjustment of the at least one mounting fixture.

In one embodiment the attachment slot comprises an elongate slot which extends along the length of the body member and in which the at least one mounting fixture is captively located.

In one embodiment each mounting fixture comprises an attachment member which provides means of attachment to a screen printing machine, a clamping element which is slideably disposed in the attachment slot in the upper edge of the body member, and at least one fixing element which couples the attachment member and the clamping element, such as to clamp the attachment member to the body member.

In one embodiment the clamping element comprises a plate.

In one embodiment the at least one fixing element comprises a threaded screw which threadedly engages the clamping element, such as to clamp the attachment member to the upper edge of the body member.

In one embodiment each mounting fixture comprises a plurality of fixing elements.

In one embodiment the attachment member comprises a body part and an attachment element which extends from the body part and provides means of attachment to a screen printing machine.

In one embodiment the attachment element comprises a stud.

In one embodiment the attachment element has an attachment axis and the body part has a lower, engagement surface which engages the upper edge of the body member when clamped thereto, such that the plane of the engagement surface relative to the axis of the attachment element defines the inclination of the mounting surface of the body member relative to the at least one mounting fixture.

In one embodiment the body part includes a projection on the engagement surface thereof, which is a sliding fit in the attachment slot in the body member.

In one embodiment the mounting surface extends along the length of a front face of the body member.

In one embodiment the mounting surface is inclined rearwardly and downwardly from the front face of the body member.

In one embodiment the body member includes a fixing slot in the front face thereof, which defines an upper edge of the mounting surface, such as to define a captive lip for receiving an upper edge of the wiper blade and aligning the wiper blade relative to the body member.

In one embodiment the at least one magnet is disposed to the body member.

In one embodiment the wiper blade holder comprises: a plurality of magnets which are disposed along the length of the body member.

In one embodiment the body member includes a plurality of recesses which house respective ones of the magnets.

In one embodiment the recesses are disposed at spaced locations along the length of the body member.

In one embodiment the recesses comprise blind recesses which open to a rear face of the body member.

In one embodiment the recesses are each configured such as to leave a shim section at the mounting surface of the body member, behind which respective ones of the magnets are disposed.

In one embodiment the at least one magnet comprises a permanent magnet.

In one embodiment the body unit comprises a retaining plate of a magnetically-susceptible material, which, by the action of the at least one magnet, acts to clamp the wiper blade to the mounting surface of the body member.

In one embodiment the retaining plate is formed of a ferromagnetic material.

In one embodiment the wiper blade holder comprises: a plurality of mounting fixtures.

The present invention also extends to a wiper blade assembly for use in a screen printing machine, comprising: the above-described wiper blade holder; and a wiper blade which is disposed to the mounting surface of the body member.

In one embodiment the wiper blade is formed of a material which is magnetically susceptible to the at least one magnet.

In one embodiment the wiper blade is formed of a ferromagnetic material.

In another embodiment the wiper blade is formed of a material which is not magnetically susceptible to the at least one magnet.

In one embodiment the wiper blade is formed of a non-ferromagnetic material.

In another aspect the present invention provides a wiper blade holder for holding a wiper blade for use in a screen printing machine, the wiper blade holder comprising: a body unit comprising a body member which includes a mounting surface to which a wiper blade is mounted; and at least one mounting fixture which is attached to the body member for mounting the wiper blade holder to a screen printing machine, wherein the at least one mounting fixture is separable from the body member, such as to allow for use of different mounting fixtures which provide for adjustment of the inclination of the mounting surface of the body member relative to the at least one mounting fixture.

In one embodiment the body member includes an attachment slot in an upper edge thereof, in which the at least one mounting fixture is slideably disposed, such as to allow for positional adjustment of the at least one mounting fixture.

In one embodiment the attachment slot comprises an elongate slot which extends along the length of the body member and in which the at least one mounting fixture is captively located.

In one embodiment each mounting fixture comprises an attachment member which provides means of attachment to a screen printing machine, a clamping element which is slideably disposed in the attachment slot in the upper edge of the body member, and at least one fixing element which couples the attachment member and the clamping element, such as to clamp the attachment member to the body member.

In one embodiment the clamping element comprises a plate.

In one embodiment the at least one fixing element comprises a threaded screw which threadedly engages the clamping element, such as to clamp the attachment member to the upper edge of the body member.

In one embodiment each mounting fixture comprises a plurality of fixing elements.

In one embodiment the attachment member comprises a body part and an attachment element which extends from the body part and provides means of attachment to a screen printing machine.

In one embodiment the attachment element comprises a stud.

In one embodiment the attachment element has an attachment axis and the body part has a lower, engagement surface which engages the upper edge of the body member when clamped thereto, such that the plane of the engagement surface relative to the axis of the attachment element defines the inclination of the mounting surface of the body member relative to the at least one mounting fixture.

In one embodiment the body part includes a projection on the engagement surface thereof, which is a sliding fit in the attachment slot in the body member.

In one embodiment the mounting surface extends along the length of a front face of the body member.

In one embodiment the mounting surface is inclined rearwardly and downwardly from the front face of the body member.

In one embodiment the body member includes a fixing slot in the front face thereof, which defines an upper edge of the mounting surface, such as to define a captive lip for receiving an upper edge of the wiper blade and aligning the wiper blade relative to the body member.

In one embodiment the wiper blade holder comprises: a plurality of mounting fixtures.

In one embodiment the wiper blade holder further comprises: at least one magnet which acts to hold the wiper blade to the mounting surface of the body member.

In one embodiment the at least one magnet is disposed to the body member.

In one embodiment the wiper blade holder comprises: a plurality of magnets which are disposed along the length of the body member.

In one embodiment the body member includes a plurality of recesses which house respective ones of the magnets.

In one embodiment the recesses are disposed at spaced locations along the length of the body member.

In one embodiment the recesses comprise blind recesses which open to a rear face of the body member.

In one embodiment the recesses are each configured such as to leave a shim section at the mounting surface of the body member, behind which respective ones of the magnets are disposed.

In one embodiment the at least one magnet comprises a permanent magnet.

In one embodiment the body unit comprises a retaining plate of a magnetically-susceptible material, which, by the action of the at least one magnet, acts to clamp the wiper blade to the mounting surface of the body member.

In one embodiment the retaining plate is formed of a ferromagnetic material.

The present invention also extends to a wiper blade assembly for use in a screen printing machine, comprising: the above-described wiper blade holder; and a wiper blade which is disposed to the mounting surface of the body member.

In one embodiment the wiper blade is formed of a material which is magnetically susceptible to the at least one magnet.

In one embodiment the wiper blade is formed of a ferromagnetic material.

In another embodiment the wiper blade is formed of a material which is not magnetically susceptible to the at least one magnet.

In one embodiment the wiper blade is formed of a non-ferromagnetic material.

In a further aspect the present invention provides a wiper blade which is formed of a material which is magnetically susceptible.

In one embodiment the wiper blade is formed of a ferromagnetic material.

In one embodiment the wiper blade comprises a continuous blade which includes no fixing apertures therein.

In a still further aspect the present invention provides a wiper blade which comprises a continuous blade which includes no fixing apertures therein.

Preferred embodiments of the present invention will now be described hereinbelow by way of example with reference to the accompanying drawings, in which:

FIGS. 1 to 5 illustrate a wiper blade holder in accordance with a first embodiment of the present invention.

Figure 1:
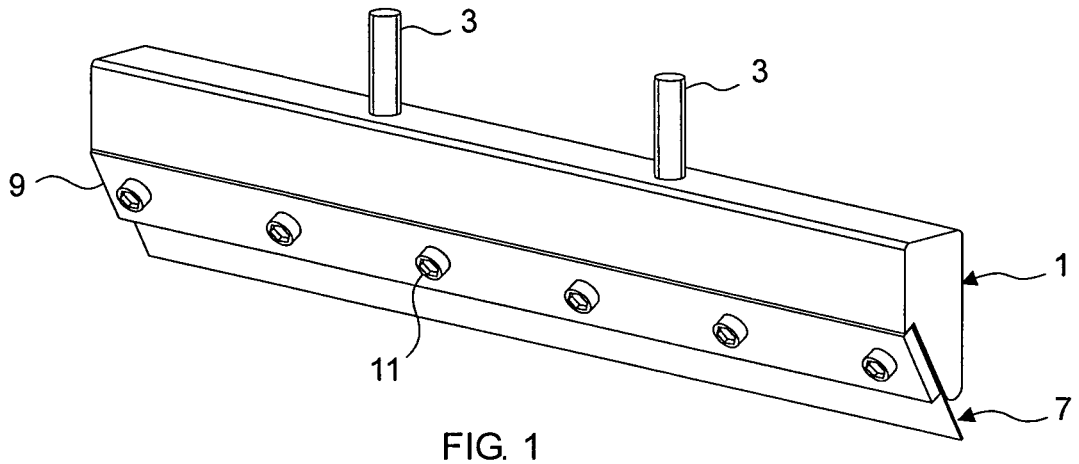
FIG. 1 illustrates a perspective view of a prior art wiper blade holder.
Figure 2:
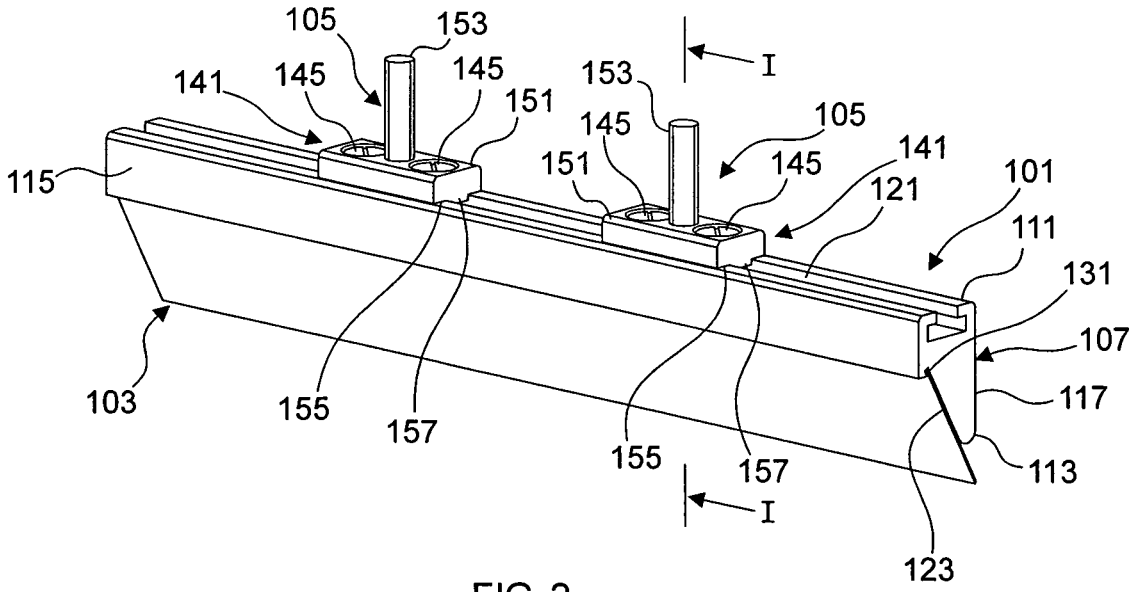
FIG. 2 illustrates a perspective view of a wiper blade holder in accordance with a first embodiment of the present invention.
Figure 3:
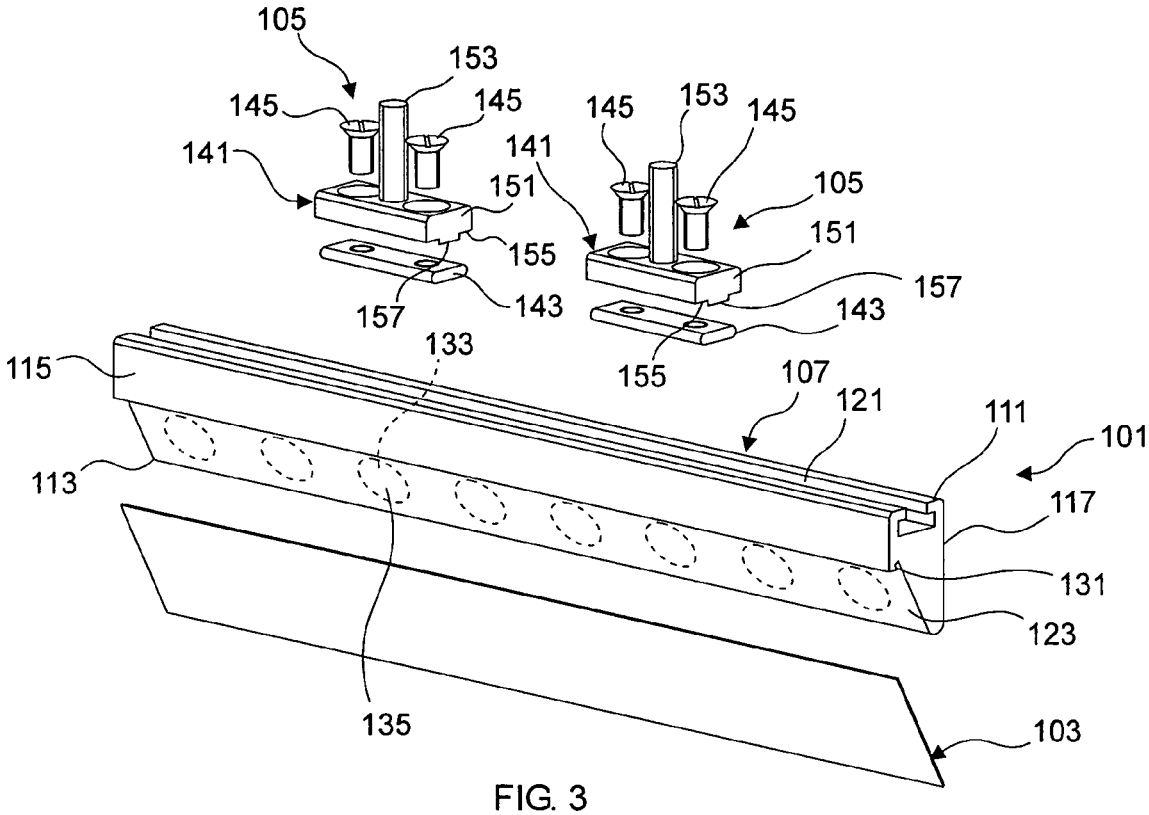
FIG. 3 illustrates an exploded perspective view of the wiper blade holder of FIG. 2.
Figure 4:
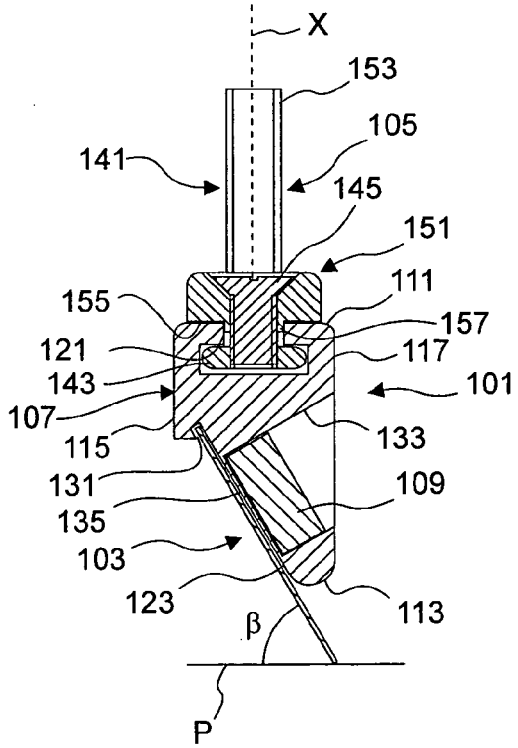
FIG. 4 illustrates a vertical sectional view (along section I-I) through the wiper blade holder of FIG. 2.

The wiper blade holder comprises a body unit 101, in this embodiment an elongate unit, a wiper blade 103, in this embodiment an elongate blade, which is formed of a magnetically-susceptible material, here of a ferromagnetic metal, and attached to the body unit 101, and a plurality of mounting fixtures 105 which are attached to the body unit 101 for mounting the wiper blade holder to a screen printing machine.

The body unit 101 comprises a body member 107, and at least one, in this embodiment a plurality of magnets 109 for attaching the wiper blade 103 to the body member 107, as will be described in more detail hereinbelow.

The body member 107 includes an upper edge 111 to which the mounting fixtures 105 are disposed, a lower, downwardly-directed edge 113, a front face 115 which supports the wiper blade 103 and a rear face 117.

The upper edge 111 includes an attachment slot 121 in which the mounting fixtures 105 are slideably disposed, such as to allow the positions of the mounting fixtures 105 to be adjusted according to the requirements of the screen printing machine.

In this embodiment the attachment slot 121 comprises an elongate slot which extends along the length of the body member 107, and is a T-shaped slot, in which the mounting fixtures 105 are captively located.

The body member 107 further includes a mounting surface 123, in this embodiment an elongate surface, which extends along the length of the front face 115 thereof, to which the wiper blade 103 is attached.

In this embodiment the mounting surface 123 is inclined rearwardly and downwardly from the front face 115 towards the rear face 117.

The body member 107 further includes a fixing slot 131, in this embodiment an elongate slot, which is located in the front face 115 at the upper edge of the mounting surface 123, such as to define a captive lip for receiving an upper edge of the wiper blade 103 and aligning the wiper blade 103 relative to the body member 107. With this configuration, the fixing slot 131 acts to prevent the upper edge of the wiper blade 103 from peeling away from the mounting surface 123, and thus be separated from the magnets 109, by a pivoting force which is created about the lower edge 113 of the body member 101 when displacing the wiper blade holder.

The body member 107 further includes a plurality of recesses 133, in this embodiment blind circular recesses, which receive respective ones of the magnets 109 and are disposed at spaced locations along the length thereof and open to the rear face 117. In this embodiment the recesses 133 are evenly spaced along the length of the body member 107, such that a substantially-uniform holding force is achieved along the length of the attached wiper blade 103.

In this embodiment the recesses 133 are configured such as to leave a thin section 135, here in the form of a shim having a thickness of about 0.7 mm, at the mounting surface 123. With this configuration, the mounting surface 123 presents a smooth, continuous surface which is easily cleaned and yet the magnets 109 present a sufficient holding force to maintain the wiper blade 103 attached to the body member 107.

In this embodiment the body member 107 is formed from an extrusion, typically an aluminium extrusion.

In one embodiment the body member 107 can be coated with a low-friction or non-stick coating, such as of Teflon®, which facilitates cleaning of the body member 107.

In this embodiment the magnets 109, here permanent disc magnets, are disposed in respective ones of the recesses 133 in the body member 107, such as to abut the respective shim sections 135. In this embodiment the magnets 109 present a relatively large surface area and have a diameter of about 19.05 mm (0.75 inch) and thickness of about 4.75 mm (0.187 inch). In this embodiment the magnets 109 are neodynium magnets, as available from Northwest Magnets (Portland, Oreg., USA) under part no ND0750X0187.

The mounting fixtures 105 each comprise an attachment member 141 which provides the means of attachment to a screen printing machine, a clamping element 143, in this embodiment a plate, which is slideably disposed in the attachment slot 121 in the upper edge 111 of the body member 107, and at least one, in this embodiment a pair of fixing elements 145, here threaded screws, which extend through the attachment member 141 and threadedly engage the clamping element 143, such that, on tightening, the fixing elements 145 act to clamp the attachment member 141 to the upper edge 111 of the body member 107.

The attachment member 141 comprises a body part 151 and an attachment element 153, in this embodiment a screw stud, which extends from the body part 151 and provides the means of attachment to a screen printing machine.

Figure 5:
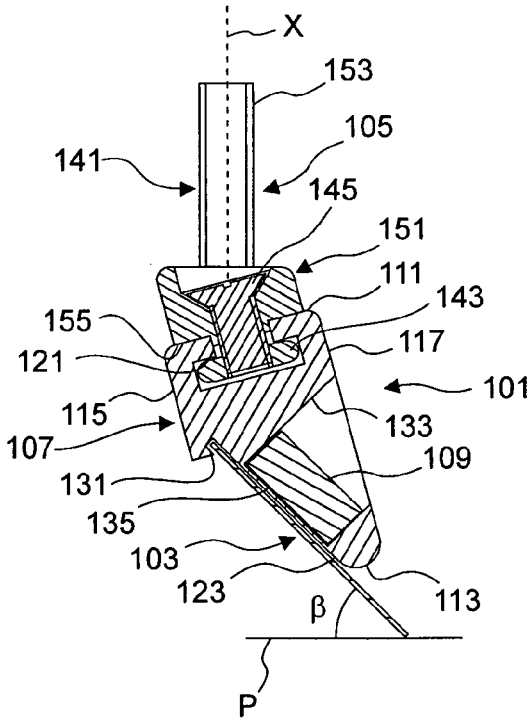
FIG. 5 illustrates a vertical sectional view through a wiper blade holder as a modification of the wiper blade holder of FIG. 2.

The body part 151 has a lower, engagement surface 155 which engages the upper edge 111 of the body member 107 when clamped thereto. In this embodiment the engagement surface 155 extends orthogonally to the axis X of the attachment element 153, such that, when the attachment element 153 is vertically directed, the wiper blade 103 encloses a predetermined, acute printing angle β with the surface of a printing screen P over which the wiper blade holder is moved. In this embodiment the printing angle β is about 60 degrees. In an alternative embodiment, as illustrated in FIG. 5, the body part 151 could be adapted such that the engagement surface 155 extends at any required angle to the axis X of the attachment element 153. By modifying the inclination of the engagement surface 155, the wiper blade 103 can be configured to enclose any required angle β with the surface of a printing screen P over which the wiper blade holder is moved. In the alternative embodiment of FIG. 5, the printing angle β is about 45 degrees.

In this embodiment the body part 151 includes a projection 157, here of elongate form, on the lower, engagement surface 155 thereof, which is a sliding fit in the attachment slot 121 in the body member 107. With this configuration, the attachment member 141 can be readily aligned to the upper edge 111 of the body member 107.

Figure 6:
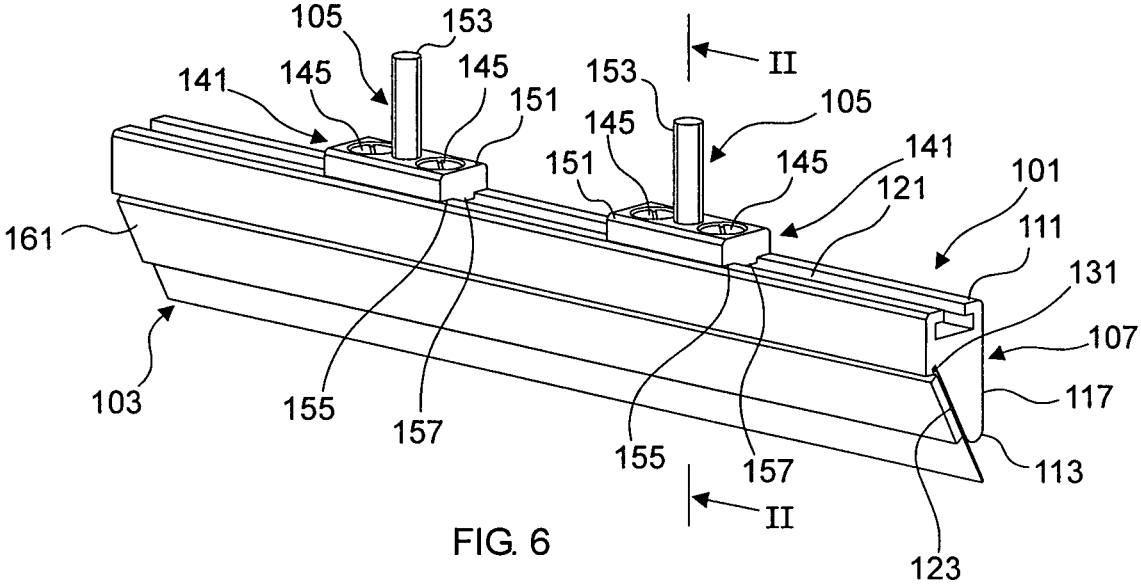
FIG. 6 illustrates a perspective view of a wiper blade holder in accordance with a second embodiment of the present invention.
Figure 7:
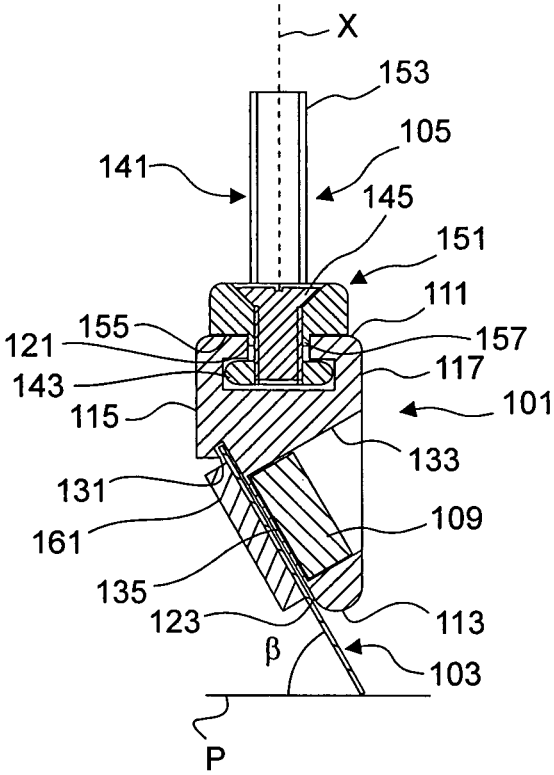
FIG. 7 illustrates a vertical sectional view (along section II-II) through the wiper blade holder of FIG. 6.

FIGS. 6 and 7 illustrate a wiper blade holder in accordance with a second embodiment of the present invention.

The wiper blade holder of this embodiment is quite similar to the wiper blade holder of the above-described first embodiment, and thus, in order to avoid unnecessary duplication of description, only the differences will be described in detail, with like reference signs designating like parts.

The wiper blade holder of this embodiment differs from that of the above-described first embodiment in that the body unit 101 further comprises a retaining plate 161 of a magnetically-susceptible material, here of a ferromagnetic material, which, by the action of the magnets 109, acts to clamp the wiper blade 103 to the body member 107. With this configuration, the wiper blade holder allows for the use of wiper blades 103 which are formed of non-ferromagnetic materials, such as plastics materials.

Finally, it will be understood that the present invention has been described in its preferred embodiments and can be modified in many different ways without departing from the scope of the invention as defined by the appended claims.

For example, in one modification, the body member 107 could include a alignment feature, typically a pin or boss, in one embodiment mid-way along the length of the fixing slot 131, and the wiper blade 103 could include a counterpart alignment feature, typically a notch, which engages the alignment feature on the body member 107, such as to facilitate alignment of the wiper blade 103 to the body member 107.

The invention claimed is:

1. A screen printing machine incorporating a wiper blade holder for holding a wiper blade, the wiper blade holder comprising:

a body unit comprising a body member which includes a mounting surface to which a wiper blade is in use mounted, wherein the mounting surface extends along a length of a front face of the body member and is inclined rearwardly and downwardly from the front face of the body member so that the wiper blade depends downwardly and rearwardly from the body member into engagement with a printing screen therebelow, over which the wiper blade holder is displaced;

a plurality of mounting fixtures which are attached to the body unit for mounting the wiper blade holder to the screen printing machine; and at least one magnet which acts to hold the wiper blade to the mounting surface of the body unit during a printing operation.

2. The screen printing machine of claim 1, wherein the body member includes an attachment slot in an upper edge thereof, in which the at least one mounting fixture is slideably disposed to allow for positional adjustment of the at least one mounting fixture.

3. The screen printing machine of claim 2, wherein the engagement surface engages the upper edge of the body member when clamped thereto so that the plane of the engagement surface relative to the axis of the attachment element defines the inclination of the mounting surface of the body member relative to the at least one mounting fixture.

4. The screen printing machine of claim 2, wherein the attachment slot comprises an elongate slot which extends along the length of the body member and in which the at least one mounting fixture is captively located.

5. The screen printing machine of claim 4, wherein each mounting fixture comprises an attachment member which provides means of attachment to the screen printing machine, a clamping element which is slideably disposed in the attachment slot in the upper edge of the body member, and at least one fixing element which couples the attachment member and the clamping element to clamp the attachment member to the body member.

6. The screen printing machine of claim 5, wherein the clamping element comprises a plate.

7. The screen printing machine of claim 5, wherein the at least one fixing element comprises a threaded screw which threadedly engages the clamping element to clamp the attachment member to the upper edge of the body member.

8. The screen printing machine of claim 5, wherein each mounting fixture comprises a plurality of fixing elements.

9. The screen printing machine of claim 5, wherein the attachment member comprises a body part and an attachment element which extends from the body part and provides means of attachment to the screen printing machine.

10. The screen printing machine of claim 9, wherein the attachment element comprises a stud.

11. The screen printing machine of claim 9, wherein the attachment element has an attachment axis and the body part has a lower, engagement surface which engages the upper edge of the body member when clamped thereto.

12. The screen printing machine of claim 11, wherein the body part includes a projection on the engagement surface thereof, which is a sliding fit in the attachment slot in the body member.

13. The screen printing machine of claim 1, wherein the body member includes a fixing slot in the front face thereof, which defines an upper edge of the mounting surface to define a captive lip for receiving an upper edge of the wiper blade and aligning the wiper blade relative to the body member.

14. The screen printing machine of claim 1, wherein the at least one magnet is disposed to the body member.

15. The screen printing machine of claim 14, comprising:

a plurality of magnets which are disposed along the length of the body member.

16. The screen printing machine of claim 15, wherein the body member includes a plurality of recesses which house respective ones of the magnets.

17. The screen printing machine of claim 16, wherein the recesses are disposed at spaced locations along the length of the body member.

18. The screen printing machine of claim 16, wherein the recesses comprise blind recesses which open to a rear face of the body member.

19. The screen printing machine of claim 18, wherein the recesses are each configured to leave a shim section at the mounting surface of the body member, behind which respective ones of the magnets are disposed.

20. The screen printing machine of claim 1, wherein the body unit comprises a retaining plate of a magnetically-susceptible or ferromagnetic material, which, by the action of the at least one magnet, acts to clamp the wiper blade to the mounting surface of the body member.

21. The screen printing machine of claim 1, further comprising:

a wiper blade which is disposed to the mounting surface of the body member.

22. The screen printing machine of claim 21, wherein the wiper blade is formed of a material which is magnetically susceptible to the at least one magnet or of a ferromagnetic material, or a material which is not magnetically susceptible to the at least one magnet or of a non-ferromagnetic material.

23. A wiper blade holder for holding a wiper blade for use in a screen printing machine, the wiper blade holder comprising:

a body unit comprising a body member which includes an upper edge and a mounting surface to which a wiper blade is in use mounted; and a plurality of sets of different mounting fixtures, each comprising at least one mounting fixture which is attached to the body member for mounting the wiper blade holder to the screen printing machine, wherein the at least one mounting fixture of each set of different mounting fixtures is separable from the body member, and each set of different mounting fixtures provides for a different inclination of the mounting surface of the body member relative to the at least one mounting fixture thereof;

wherein each mounting fixture comprises an attachment member which provides means of attachment to the screen printing machine, the attachment member comprising a body part and an attachment element which extends from the body part and provides means of attachment to the screen printing machine, wherein the attachment element has an attachment axis and the body part has a lower, engagement surface which engages the upper edge of the body member when clamped thereto, the engagement surface engaging the upper edge of the body member when clamped thereto so that the plane of the engagement surface relative to the axis of the attachment element defines the inclination of the mounting surface of the body member relative to the at least one mounting fixture.

24. The wiper blade holder of claim 23, wherein the body member includes an attachment slot in the upper edge thereof, in which the at least one mounting fixture is slideably disposed to allow for positional adjustment of the at least one mounting fixture.

25. The wiper blade holder of claim 24, wherein the attachment slot comprises an elongate slot which extends along the length of the body member and in which the at least one mounting fixture is captively located.

26. The wiper blade holder of claim 25, wherein each mounting fixture comprises a clamping element which is slideably disposed in the attachment slot in the upper edge of the body member, and at least one fixing element which couples the attachment member and the clamping element to clamp the attachment member to the body member.

27. The wiper blade holder of claim 26, wherein the clamping element comprises a plate.

28. The wiper blade holder of claim 26, wherein the at least one fixing element comprises a threaded screw which threadedly engages the clamping element to clamp the attachment member to the upper edge of the body member.

29. The wiper blade holder of claim 26, wherein each mounting fixture comprises a plurality of fixing elements.

30. The wiper blade holder of claim 23, wherein each set of different mounting fixtures comprises a plurality of mounting fixtures.

31. The wiper blade holder of claim 23, wherein the attachment element comprises a stud.

32. The wiper blade holder of claim 23, wherein the body part includes a projection on the engagement surface thereof, which is a sliding fit in the attachment slot in the body member.

33. A wiper blade holder for holding a wiper blade for use in a screen printing machine, the wiper blade holder comprising:

a body unit comprising a body member which includes a mounting surface to which a wiper blade is in use mounted, wherein the mounting surface extends along the length of a front face of the body member, wherein the body member includes a fixing slot in the front face thereof, which defines an upper edge of the mounting surface to define a captive lip for receiving an upper edge of the wiper blade and aligning the wiper blade relative to the body member; and a plurality of sets of different mounting fixtures, each comprising at least one mounting fixture which is attached to the body member for mounting the wiper blade holder to the screen printing machine, wherein the at least one mounting fixture of each set of different mounting fixtures is separable from the body member, and each set of different mounting fixtures provides for a different inclination of the mounting surface of the body member relative to the at least one mounting fixture thereof.

34. The wiper blade holder of claim 33, wherein the mounting surface is inclined rearwardly and downwardly from the front face of the body member.

35. A wiper blade holder for holding a wiper blade for use in a screen printing machine, the wiper blade holder comprising:

a body unit comprising a body member which includes a mounting surface to which a wiper blade is in use mounted;

at least one magnet which acts to hold the wiper blade to the mounting surface of the body member; and a plurality of sets of different mounting fixtures, each comprising at least one mounting fixture which is attached to the body member for mounting the wiper blade holder to the screen printing machine, wherein the at least one mounting fixture of each set of different mounting fixtures is separable from the body member, and each set of different mounting fixtures provides for a different inclination of the mounting surface of the body member relative to the at least one mounting fixture thereof.

36. The wiper blade holder of claim 35, wherein the at least one magnet is disposed to the body member.

37. The wiper blade holder of claim 36, comprising:

a plurality of magnets which are disposed along the length of the body member.

38. The wiper blade holder of claim 37, wherein the body member includes a plurality of recesses which house respective ones of the magnets.

39. The wiper blade holder of claim 38, wherein the recesses are disposed at spaced locations along the length of the body member.

40. The wiper blade holder of claim 38, wherein the recesses comprise blind recesses which open to a rear face of the body member.

41. The wiper blade holder of claim 40, wherein the recesses are each configured to leave a shim section at the mounting surface of the body member, behind which respective ones of the magnets are disposed.

42. The wiper blade holder of claim 35, wherein the body unit comprises a retaining plate of a magnetically-susceptible material, which, by the action of the at least one magnet, acts to clamp the wiper blade to the mounting surface of the body member.

43. A wiper blade assembly for use in a screen printing machine, comprising:

a wiper blade holder for holding a wiper blade for use in a screen printing machine, the wiper blade holder comprising a body unit comprising a body member which includes a mounting surface to which a wiper blade is in use mounted, at least one magnet which acts to hold the wiper blade to the mounting surface of the body member, and a plurality of sets of different mounting fixtures, each comprising at least one mounting fixture which is attached to the body member for mounting the wiper blade holder to the screen printing machine, wherein the at least one mounting fixture of each set of different mounting fixtures is separable from the body member, and each set of different mounting fixtures provides for a different inclination of the mounting surface of the body member relative to the at least one mounting fixture thereof; and a wiper blade which is disposed to the mounting surface of the body member.

44. The wiper blade assembly of claim 43, wherein the wiper blade is formed of a material which is magnetically susceptible to the at least one magnet or of a ferromagnetic material, or a material which is not magnetically susceptible to the at least one magnet or of a non-ferromagnetic material.

* * * * *